US009247790B2

(12) United States Patent
Illulian

(10) Patent No.: US 9,247,790 B2
(45) Date of Patent: Feb. 2, 2016

(54) CLOTHING ADJUSTING ZIPPER ARRANGEMENT

(71) Applicant: Khosro David Illulian, Los Angeles, CA (US)

(72) Inventor: Khosro David Illulian, Los Angeles, CA (US)

( * ) Notice: Subject to any disclaimer, the term of this patent is extended or adjusted under 35 U.S.C. 154(b) by 0 days.

(21) Appl. No.: 14/742,151

(22) Filed: Jun. 17, 2015

(65) Prior Publication Data

US 2015/0282570 A1 Oct. 8, 2015

Related U.S. Application Data

(63) Continuation of application No. PCT/US2015/017691, filed on Feb. 26, 2015.

(60) Provisional application No. 61/947,309, filed on Mar. 3, 2014.

(51) Int. Cl.

| | |
|---|---|
| ***A41D 3/02*** | (2006.01) |
| ***A44B 19/26*** | (2006.01) |
| ***A41F 1/00*** | (2006.01) |
| ***A41D 1/02*** | (2006.01) |
| ***A41D 1/04*** | (2006.01) |
| ***A41D 1/22*** | (2006.01) |
| ***A44B 17/00*** | (2006.01) |
| ***A44B 18/00*** | (2006.01) |
| ***A44B 19/02*** | (2006.01) |
| ***A47G 9/08*** | (2006.01) |
| ***E04H 15/32*** | (2006.01) |
| ***A44B 19/00*** | (2006.01) |

(52) U.S. Cl.

CPC . *A44B 19/26* (2013.01); *A41D 1/02* (2013.01); *A41D 1/04* (2013.01); *A41D 1/22* (2013.01); *A41F 1/00* (2013.01); *A41F 1/008* (2013.01); *A44B 17/0064* (2013.01); *A44B 18/0073* (2013.01); *A44B 19/00* (2013.01); *A44B 19/02* (2013.01); *A47G 9/08* (2013.01); *E04H 15/32* (2013.01); *A41D 2300/322* (2013.01); *A41D 2400/38* (2013.01); *Y10T 24/2502* (2015.01); *Y10T 24/2514* (2015.01)

(58) Field of Classification Search

CPC ..... A41D 1/22; A41D 1/20; A41D 27/10; A41B 1/08; A41F 1/008; A41F 5/00; A41F 1/00

USPC ..... 2/74, 121, 221, 270, 96; 24/686

See application file for complete search history.

(56) References Cited

U.S. PATENT DOCUMENTS 2,111,924 A * 3/1938 Etten ..... A41D 1/06 2/234

2,609,581 A * 9/1952 Noel Statham ..... A41F 1/008 24/686

(Continued)

FOREIGN PATENT DOCUMENTS

CN 203016014 U 6/2013

OTHER PUBLICATIONS

International Search Report and Written Opinion.

*Primary Examiner* — Tejash Patel

(74) *Attorney, Agent, or Firm* — Notaro, Michalos & Zaccaria P.C.

(57) ABSTRACT

An adjustable article has an area of overlapping fabric with facing surfaces and a zipper on one of the surfaces. A zipper slider with fastener moves along two rows of teeth of the zipper to cause them to be separated in one direction and interdigitate in an opposite direction. A connector at the other surface and at one end of a distance of a dimension to be adjusted is engaged to the fastener so that a degree of overlap of the overlapping fabric surfaces changes as the slider moves along the rows of teeth to change the dimension.

15 Claims, 8 Drawing Sheets

(56) References Cited

U.S. PATENT DOCUMENTS 3,255,503 A * 6/1966 Sozzi ..... A44B 19/301 24/387
3,271,832 A * 9/1966 Yankers ..... A44B 19/301 2/234
3,448,463 A * 6/1969 Milone ..... A41D 1/06 2/234
3,793,645 A * 2/1974 Kadison ..... A41F 9/025 2/221
5,263,201 A 11/1993 Hood
6,385,777 B1 * 5/2002 Hamada ..... A41F 9/025 2/221
7,516,499 B2 * 4/2009 Gardner, III ..... A41D 1/20 2/221
8,250,670 B2 * 8/2012 Nishikawa ..... A41D 1/22 2/74

* cited by examiner

CLOTHING ADJUSTING ZIPPER ARRANGEMENT

CROSS-REFERENCE TO RELATED APPLICATION

This application is a continuation of PCT/US2015/017691 filed Feb. 26, 2015, which claims priority on U.S. provisional patent application No. 61/947,309 filed Mar. 3, 2014, which is incorporated herein by reference in its entirety.

FIELD AND BACKGROUND OF THE INVENTION

The present invention relates generally to the field of clothing, and in particular to a new and useful clothing adjusting zipper arrangement that is used to adjust at least one dimension of a cloth or fabric item, for example, the size of a garment.

Zippers have long been used as closures for cloth and fabric items, including garments, apparel, upholstery and furniture coverings, camping gear like tents, sleeping bags or other shelters, textiles and sporting goods. For ease of reference, all such cloth or fabric items are here referred to generally as clothing items.

Zippers include a pair of tapes, often but not always of cloth, that are attached, for example by sewing, to opposite edges of a closure. Two chains or rows of teeth on facing edges of the tapes are capable of meshing with each other by being caused to interdigitate as a zipper slider that embraces both rows past the teeth. A zipper pull is attached to the slider to be held by a person opening or closing the zipper.

SUMMARY OF THE INVENTION

The invention is a new arrangement using one or more zippers and their sliders, to adjust the size of an item of clothing.

It is an object of the present invention to provide a concealed and/or exposed zipper, open or closed, ended with a button, VELCRO brand fastener, clasp, hook or other fastening device of different shapes and sizes, sewn or attached onto the slider body or pull tab of the zipper that can slide back and forth on the chain or row of teeth of the zipper for the use in all types of garments, apparel, upholstery and furniture coverings, camping gear, textiles or sporting goods (separately or collectively called clothing in this disclosure), to adjust the circumference or length of at least one dimension of the clothing.

The zipper can be used to change or vary the size of any of the above mentioned items in width, length and/or height. As a non-limiting example, the invention can be used to adjust the circumference or girth of a jacket or other article of clothing. The zipper can be exposed or hidden by being sewed either on the inside or outside of the fabric or textile of the clothing to be adjusted.

Accordingly an object of the invention is to provide a clothing adjusting zipper arrangement, understanding the category of cloth or fabric items referred to as clothing in this disclosure, that comprises an area of overlapping fabric having facing surfaces in the item that overlap at least by a distance of a dimension of the item to be adjusted, a zipper having a pair of tapes with a respective pair of interdigitating rows of teeth and a slider for moving along the teeth to cause the teeth to become separated in one direction of movement of the slider and to become interdigitated in an opposite direction of movement of the slider, the zipper being fixed along one of the facing surfaces in the area of overlap and extending at least partly in the dimension of the item to be adjusted, a fastener connected to the slider, and a connector at the other of the facing surfaces and at one end of the distance of the dimension of the item to be adjusted, the fastener engaging the connector so that a degree of overlap of the overlapping fabric surfaces changes as the slider moves along the rows of teeth to change the dimension.

Another object of the invention is to provide an article in which the position of the slider along the zipper arrangement may be pre-adjusted before engagement of the fastener with the connector.

It is also within the objects of the invention to provide an article which includes at least two zipper arrangements, adapted such that the fasteners of the respective zipper arrangements may be aligned along different vertical axes.

In certain embodiments, the fastener is a button provided on one of the facing surfaces and the connector is an opening defined by the facing surface opposite the facing surface on which the zipper arrangement is provided.

In alternative embodiments, the fastener is a hook portion of a hook-and-loop fastener and the connector is a loop portion of a hook-and-loop fastener.

In yet further embodiments, the fastener is a male portion of a snap fastener and the connector is the female portion of a snap fastener.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
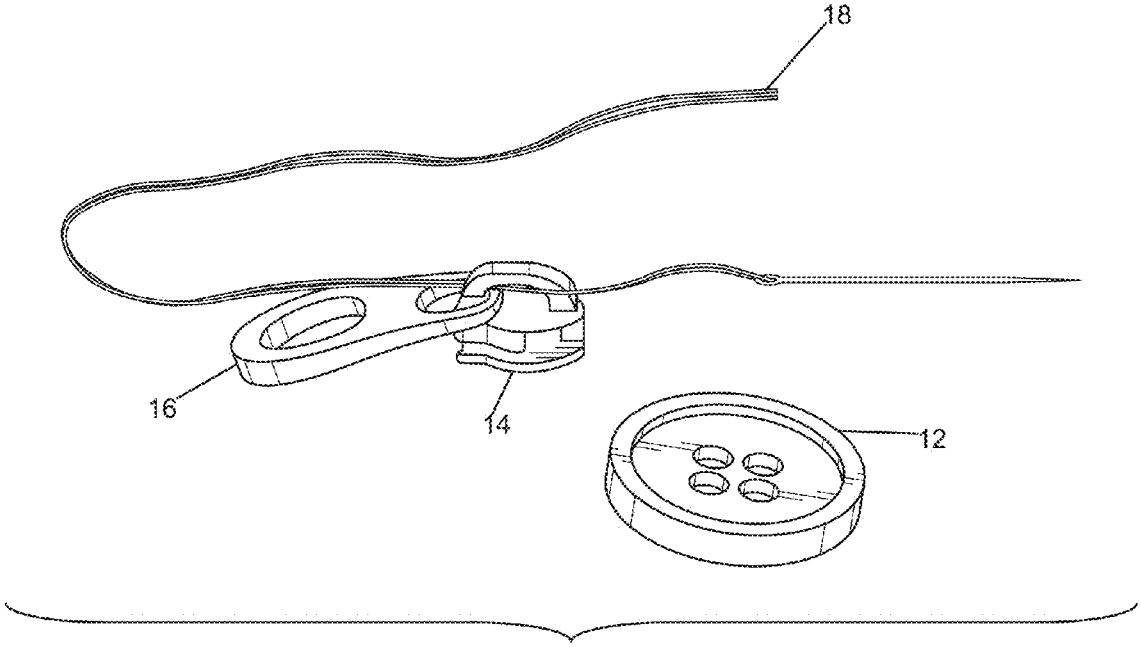
FIG. 1 shows the fastener, slider body, and pull tab according to the present invention, before the fastener is secured to the slider body.
Figure 2:
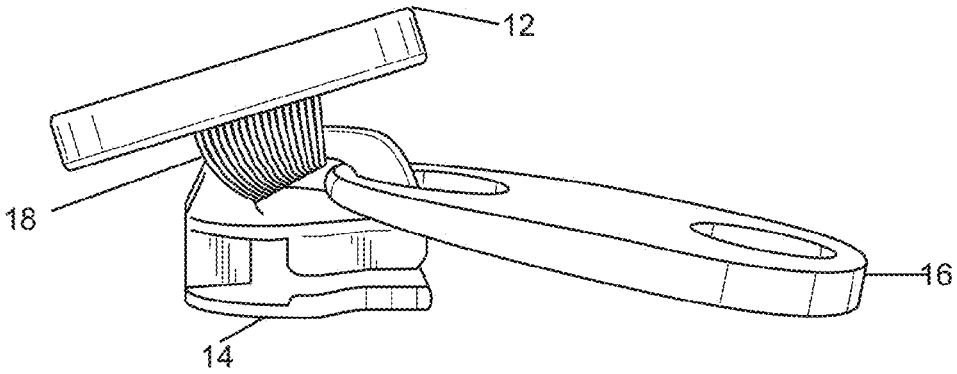
FIG. 2 shows the fastener, slider body and pull tab united together.
Figure 3:
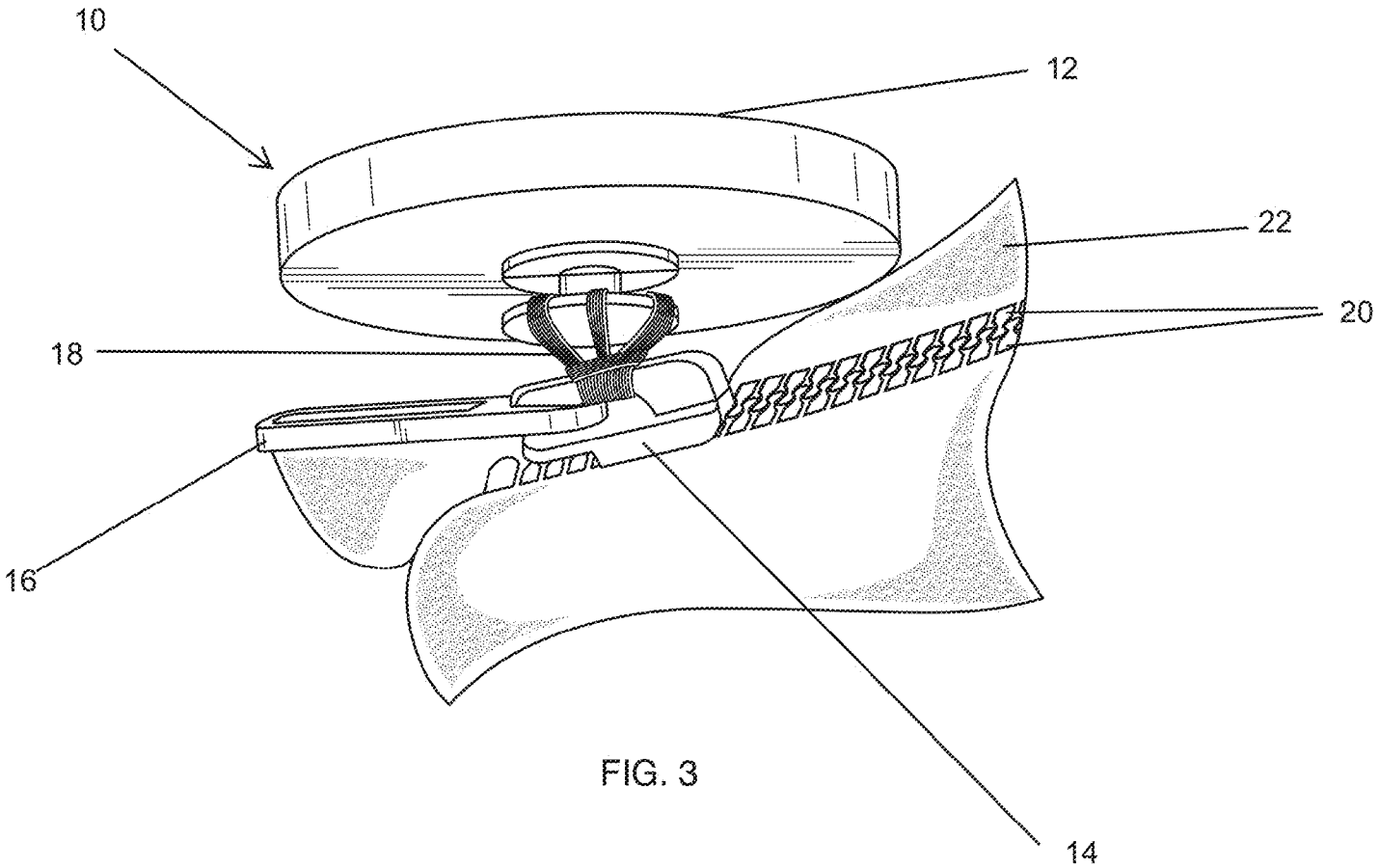
FIG. 3 shows the fastener, slider body and pull tab, united and now engaged with the pair of zipper teeth.
Figure 14:
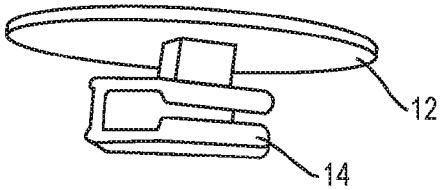
FIG. 14 is a view of a zipper slider with integrated fastener according to the invention.

Referring now to the drawings, FIG. 1 shows a fastener 12, a slider body 14 with a loop and a pull tab 16 connected to the loop of the slider 14, at a time before the fastener 12 and the slider body 14 are tied together by tying means 18 according to the present invention. FIG. 2 shows the fastener 12, slider body 14 and pull tab 16 united for engagement with a pair of zipper teeth 20 (FIG. 3). FIG. 3 shows the fastener 12, slider body 14 and pull tab 16, united and now engaged with the pair of zipper teeth 20, the zipper teeth 20 being supported by respective strips of zipper tape 22. The fastener 12 may be a button or the like, but it is by no means limited thereto. The tying means 18 may be a thread or any convenient means effective for achieving the purpose of securing the fastener 12 to the slider body 14. It is also within the scope of the invention for the fastener to 12 to be secured to the pull tab 16, or some part of the slider body, other than the loop, or to be made as one piece with the slider body as illustrated in FIG. 14.

Figure 4:
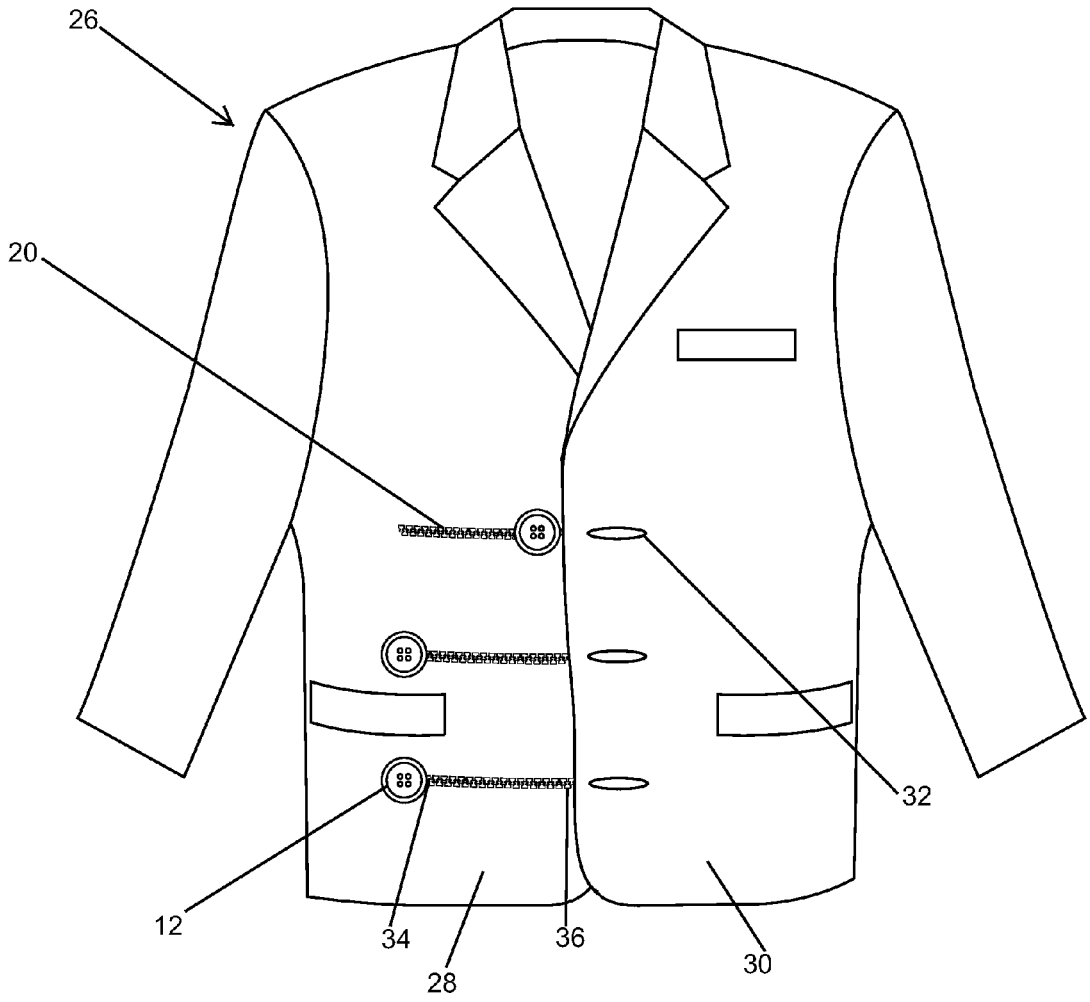
FIG. 4 is a front view of a jacket embodiment of the present invention.

FIG. 4 shows a preferred jacket 26 embodiment according to the present invention which employs the zipper arrangement 10. Although three zipper arrangements 10 are shown, a single zipper arrangement 10 would be effective for achieving the objects of the invention. Likewise, more than three zipper arrangements 10 may be employed. As can be seen in FIG. 4, the jacket 26 has a first flap 28 and a second flap 30. Although the zipper teeth 20 are shown exposed in FIG. 4, it is within the scope of the invention for the zipper teeth 20 to be concealed.

Figure 5:
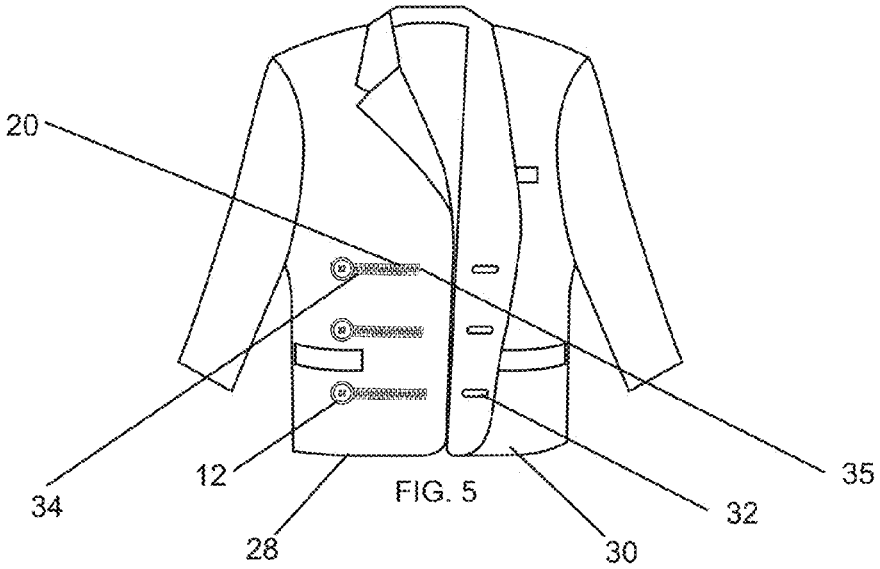
FIG. 5 is a front view of the jacket embodiment in the unfastened state.
Figure 6:
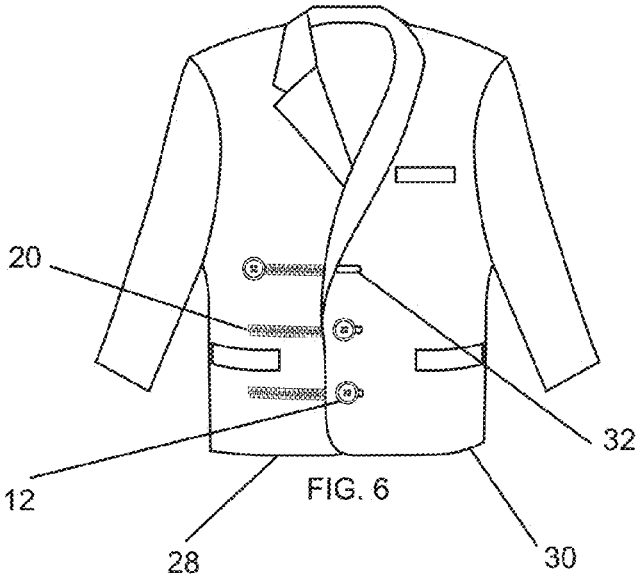
FIG. 6 is a front view of the jacket embodiment in the partially-fastened state.
Figure 7:
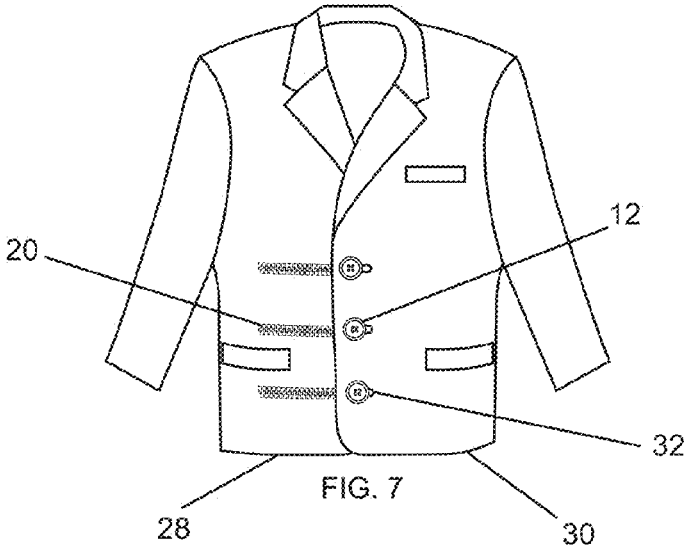
FIG. 7 is a front view of the jacket embodiment in the fully-fastened state.

FIGS. 5-7 show that the jacket 26 may be worn in an unfastened state (FIG. 5), in a partially fastened state (FIG. 6) and a fully-fastened state (FIG. 7). FIG. 5 shows the unfastened state, in which none of the fasteners 12 are inserted through the corresponding fastener connectors 32. FIG. 6 shows a partially-fastened state, in which some fasteners 12 are inserted through the associated fastener connector 32 and some are not. FIG. 7 shows the fully-fastened state, in which all the fasteners 12 are inserted through their respective fastener connectors 32. In the embodiment shown, the fasteners 12 are buttons and the fastener connectors 32 are button holes 32. However, it is within the scope of the invention for any fastener-connector means to be employed, such as, for example, a snap-fastener arrangement, a hook-and-loop fastener (e.g., VELCRO), a clasp, or a hook.

Figure 8:
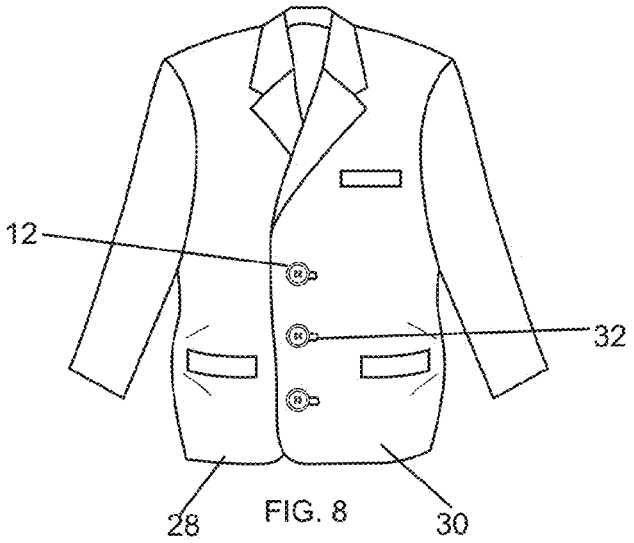
FIG. 8 is a front view of the jacket in a most-constricted state.
Figure 9:
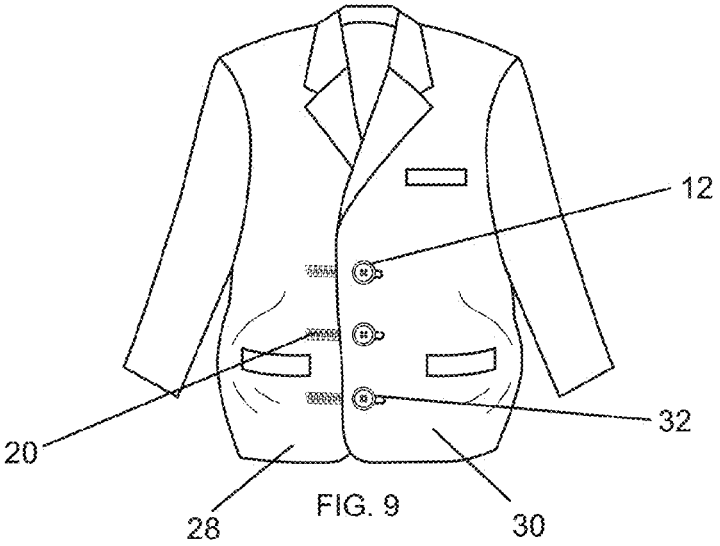
FIG. 9 is a front view of the jacket in a semi-constricted state.
Figure 10:
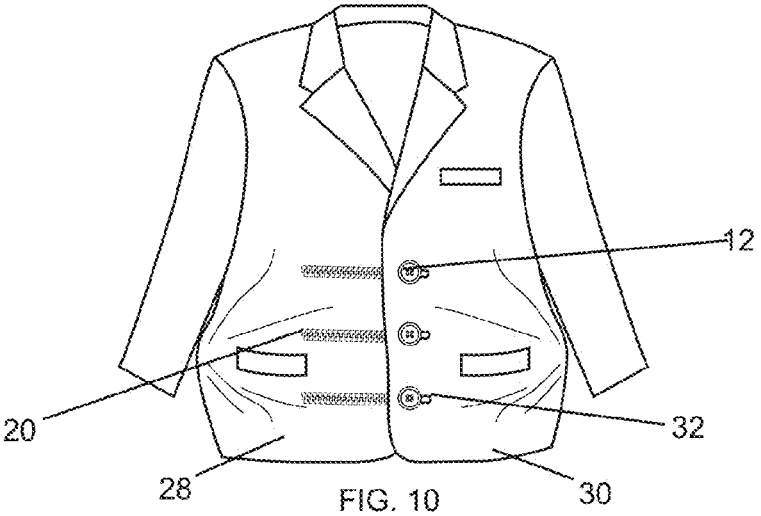
FIG. 10 is a front view of the jacket in a least-constricted state.

FIGS. 8-10 show that, once in the fully-fastened state (FIG. 7) the jacket 26 of the present invention may be adjusted to accommodate a variety of sizes. The jacket 26 may be adjusted by varying the distance of the fasteners 12 along the length of the zipper arrangement 10 to any degree desired, according the comfort of the wearer.

In FIG. 8, the jacket 26 is in the most-constricted state. From this state, the jacket 26 may be expanded to a semi-constricted state shown in FIG. 9, if, for example, the wearer of the garment has experienced an expansion of girth (e.g., due to dietary or health reasons). It may also be desirable to expand the garment if it has been transferred to a different person who has a wider girth than the original wearer. In FIG. 9, the fasteners 12 remain in the fastener connectors 32, and the first flap 28 and the second flap 30 are pulled away from one another. Because the fasteners 12 remain anchored in the connectors 32, the effect is that the fasteners 12 slide along the length of the zipper arrangement 10 from a first end 34 towards a second end 36 (the first and second end are best seen in FIGS. 4 and 5 which show the unfastened state), to a point roughly near the middle of the zipper arrangement 10, depending on the comfort of the wearer. FIG. 10 shows the least-constricted state of the garment. In FIG. 10, the fasteners 12 remain in the fastener connectors 32, and the first flap 28 and the second flap 30 are pulled yet further away from one another. The fasteners 12 slide further along the length of the zipper arrangement 10, that is, to a point at or near the second end 36 of the zipper arrangement 10.

The jacket 26 may also be adjusted back from the least-constricted state (FIG. 10) to the semi-constricted state (FIG. 9) or to the most-constricted state (FIG. 8) by holding the first flap 28 stationary and pulling the second flap 30 such that its degree of overlap over the first flap 28 is increased.

Figure 11:
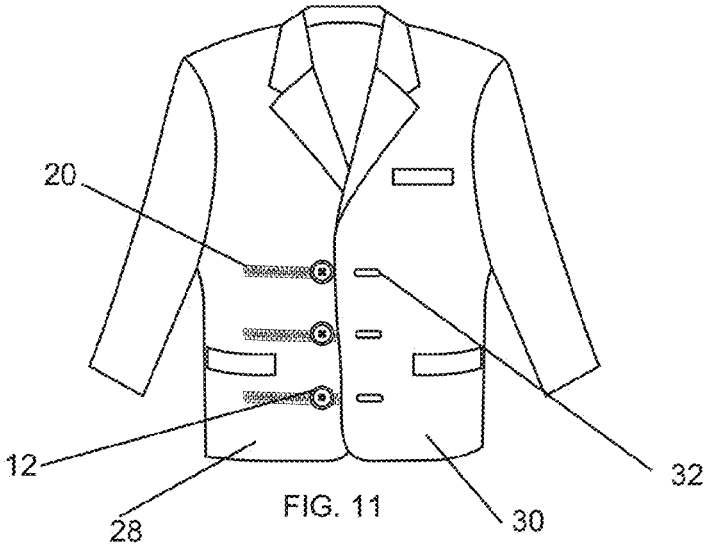
FIG. 11 is a front view of the jacket in an unfastened state with all the fasteners aligned uniformly at one end of the first flap.
Figure 12:
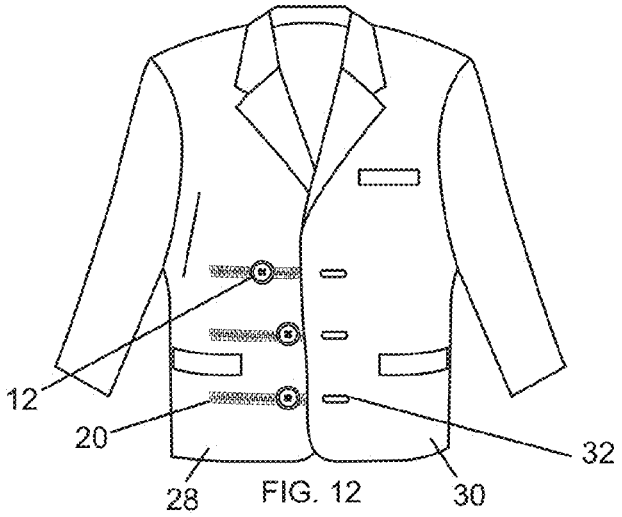
FIG. 12 is a front view of the jacket in the unfastened state with two of the fasteners aligned at one end of the first flap and one fastener located at about the middle of the first flap.
Figure 13:
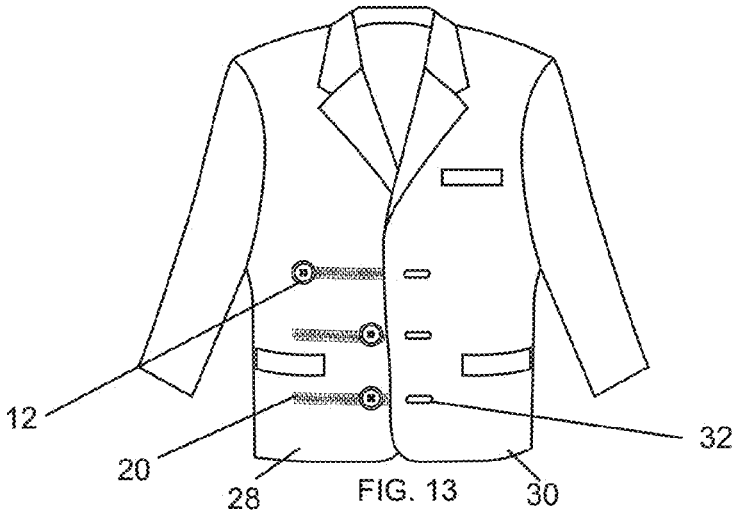
FIG. 13 is a front view of the jacket in the unfastened state with two of the fasteners aligned at one end of the first flap and one fastener located at an opposite end the first flap.

It also within the scope for the size of the jacket 26 to be adjusted when the jacket 26 is in the fully-unfastened state. Here, the wearer pre-adjusts the positions of the fasteners 12 along length of the zipper arrangement 10. As shown in FIGS. 11-13, it is well within the scope of the invention for the fasteners 12 to positioned at varying distances along the length of their respective zipper arrangements 10. After the fasteners 12 have been positioned according the wearer's desire, the fasteners 12 may then be secured through the connectors 32.

Figure 15:
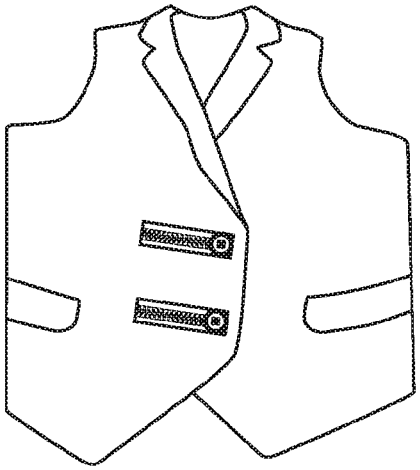
FIG. 15 is a view of a different item of garment clothing, i.e. a vest, using the present invention.
Figure 16:
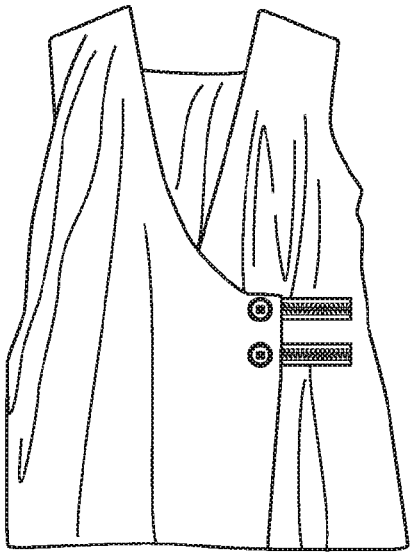
FIG. 16 is a view of a still further garment, i.e. a dress, using the present invention.

FIG. 15 shows the invention applied to a vest and FIG. 16 shows the invention applied to a dress.

The present invention is advantageous in contexts where an individual has eaten a large meal or is experiencing a gastric condition requiring additional accommodation in the abdominal region.

The present invention is also advantageous in contexts where garments are transferred frequently from one person to the next, such as in the tuxedo rental, military and law enforcement fields.

The present invention may also be used in used in connection with camping gear (e.g., sleeping bags and tents) and sporting goods.

While a specific embodiment of the invention has been shown and described in detail to illustrate the application of the principles of the invention, it will be understood that the invention may be embodied otherwise without departing from such principles.

What is claimed is:

1. An adjustable article comprising:

an area of overlapping fabric having facing surfaces of the article that overlap at least by a distance of a dimension of the article to be adjusted;

at least one zipper arrangement having a pair of tapes with a respective pair of interdigitating rows of teeth and a slider for moving along the teeth to cause the teeth to become separated in one direction of movement of the slider and to become interdigitated in an opposite direction of movement of the slider, the at least one zipper arrangement being fixed along one of the facing surfaces in the area of overlap and extending at least partly in the dimension of the article to be adjusted;

a fastener connected to the slider for moving with the slider; and a connector at the other of the facing surfaces and at one end of the distance of the dimension of the article to be adjusted, the fastener being engaged to the connector so that a degree of overlap of the overlapping fabric surfaces changes when the slider moves along the rows of teeth from one location to another location along the at least one zipper arrangement, to change the dimension.

2. The adjustable article of claim 1, wherein the article is an article of clothing.

3. The adjustable article of claim 2, wherein the article of clothing is a jacket.

4. The adjustable article of claim 1, wherein the article is an article of camping gear.

5. The adjustable article of claim 4, wherein the article of camping gear is a sleeping bag.

6. The adjustable article of claim 4, wherein the article of camping gear is a tent.

7. The adjustable article of claim 1, wherein the article is an article of sporting goods.

8. The adjustable article of claim 1, wherein the position of the slider along the at least one zipper arrangement is pre-adjusted before engagement of the fastener with the connector.

9. The adjustable article of claim 1, wherein the at least one zipper arrangement comprises at least two zipper arrangements, adapted such that the fasteners of the respective zipper arrangements are aligned along different vertical axes.

10. The adjustable article of claim 1, wherein the fastener is a button provided on one of the facing surfaces and the connector is an opening defined by the facing surface opposite the facing surface on which the at least one zipper arrangement is provided.

11. The adjustable article of claim 1, wherein the fastener is a hook portion of a hook-and-loop fastener and the connector is a loop portion of a hook-and-loop fastener.

12. The adjustable article of claim 1, wherein the fastener is a male portion of a snap fastener and the connector is the female portion of a snap fastener.

13. The adjustable article of claim 1, wherein the article is a vest.

14. The adjustable article of claim 1, wherein the article is a dress.

15. The adjustable article of claim 1, wherein the fastener and the slider are made as one piece.

* * * * *